US008940226B2

(12) United States Patent
Simoes et al.

(10) Patent No.: US 8,940,226 B2
(45) Date of Patent: Jan. 27, 2015

(54) ARRANGEMENT FOR BURNING BLAST FURNACE OFF-GAS FROM A BLEEDER VALVE AND CORRESPONDING BLEEDER VALVE

(75) Inventors: Jean-Paul Simoes, Walferdange (LU); Jeannot Loutsch, Mondercange (LU); Lionel Hausemer, Steinsel (LU)

(73) Assignee: Paul Wurth S.A., Luxembourg (LU)

( * ) Notice: Subject to any disclaimer, the term of this patent is extended or adjusted under 35 U.S.C. 154(b) by 259 days.

(21) Appl. No.: 13/320,599

(22) PCT Filed: May 19, 2010

(86) PCT No.: PCT/EP2010/056867

§ 371 (c)(1), (2), (4) Date: Nov. 15, 2011

(87) PCT Pub. No.: WO2010/133623

PCT Pub. Date: Nov. 25, 2010

(65) Prior Publication Data

US 2012/0055382 A1 Mar. 8, 2012

(30) Foreign Application Priority Data

May 19, 2009 (LU) ..... 91570

(51) Int. Cl.
*F27D 17/00* (2006.01)
*C21B 7/00* (2006.01)
*C21B 9/12* (2006.01)

(52) U.S. Cl.
CPC ..... *F27D 17/008* (2013.01); *C21B 7/005* (2013.01); *C21B 9/12* (2013.01)
USPC ..... 266/196; 266/199

(58) Field of Classification Search
CPC ..... C21B 7/005; C21B 9/12
USPC ..... 266/174, 196, 199
See application file for complete search history.

(56) References Cited

U.S. PATENT DOCUMENTS

| | | | | |
|---|---|---|---|---|
| 2,888,981 | A * | 6/1959 | Ripple | 431/29 |
| 3,601,357 | A | 8/1971 | Legille | |
| 3,907,261 | A | 9/1975 | Legille | |
| 4,158,367 | A | 6/1979 | Mailliet | |
| 8,034,284 | B2 * | 10/2011 | Lonardi et al. | 266/196 |
| 2012/0055382 | A1 * | 3/2012 | Simoes et al. | 110/208 |

FOREIGN PATENT DOCUMENTS

| | | | |
|---|---|---|---|
| JP | 54107806 | A | 8/1979 |
| WO | 2007090747 | A1 | 8/2007 |

OTHER PUBLICATIONS

International Search Report OCT/EP2010/056867; Dated Aug. 23, 2010.

* cited by examiner

*Primary Examiner* — Scott Kastler
(74) *Attorney, Agent, or Firm* — Cantor Colburn LLP

(57) ABSTRACT

The invention proposes an arrangement for burning blast furnace off-gas from a bleeder valve. It comprises a bleeder valve (20) having a fixed hollow valve body (22) defining an outlet (26) and a valve seat and a movable obturator (24) that cooperates with the valve seat for closing the bleeder valve and releasing blast furnace off-gas through the outlet. The arrangement includes an apparatus for combustion of blast furnace off-gas released by the bleeder valve (20). This apparatus is characterized by an ignition device (32, 38, 40, 42, 44) that is arranged on or adjacent the valve body or the moveable obturator of the bleeder valve (20) itself. The ignition device (32, 38, 40, 42, 44) has its spatial ignition range located downstream the outlet in a region where blast furnace off-gas released through the outlet mixes with ambient air when the obturator is in an open position so as to allow open-air combustion of blast furnace off-gas released into ambient air at the location of the bleeder valve.

19 Claims, 5 Drawing Sheets

ARRANGEMENT FOR BURNING BLAST FURNACE OFF-GAS FROM A BLEEDER VALVE AND CORRESPONDING BLEEDER VALVE

TECHNICAL FIELD

The present invention generally relates to blast furnace bleeder valves, and more specifically to an arrangement that enables combustion of hazardous constituents of blast furnace off-gas released through a bleeder valve.

BACKGROUND

Modern blast furnaces are designed to operate at a nominal furnace pressure in the range of 1-3 bar above atmospheric. To protect the furnace and its auxiliary equipment from any sudden gas pressure surge, bleeder valves are typically provided at the top of a blast furnace. Such pressure surges occur e.g. due to slips or hangings in the burden or due to problems in blower operation or pressure regulation. Accordingly, bleeder valves act as safety relieve valves that open at a given threshold to relieve excess pressure.

In a typical blast furnace installation, two bleeder valves are arranged at the furnace top, each at the upper end of a respective bleeder pipe that rises upwards from and connects to the uppermost point of a pair of uptakes. The uptakes are ducts from which blast furnace gas is withdrawn for further use from the furnace top cone. The uptakes normally join above the furnace charging installation, each being connected to a duct called downcomer, through which the blast furnace gas descends to a treatment installation. An additional bleeder valve may be connected to the secondary blast furnace gas cleaning installation, e.g. to a scrubber.

Depending on the design, a bleeder valve can be operated both automatically and manually. Some bleeder valves are operated hydraulically or pneumatically through pressure lines that cause the valve to open in case of excess pressure. Normally, the latter type also allows manual opening of the valve, e.g. in case of a furnace shutdown. Another type of bleeder valves are usually counterweighted or spring-biased so that they will open without the need of external power when the pressure significantly exceeds normal operating pressure. Improved bleeder valve designs developed by PAUL WURTH, commonly referred to as "coffee-pot" bleeders, combine both functionalities, i.e. controlled full opening by use of external power and independent emergency opening by action of the furnace pressure against resilient bias. Examples of this type of bleeder valve are disclosed in U.S. Pat. Nos. 3,601,357 and 4,158,367. A "coffee-pot" bleeder having an improved design of the obturator is disclosed in international patent application no. WO 2007/090747. Irrespective of their design, the bleeder valves are usually configured to release blast furnace off-gas to the atmosphere.

In a conventional process, blast furnace gas typically contains around 45-55% of $N_2$, around 15-25% of CO, around 15-25% of $CO_2$ and around 1-10% of $H_2$. Under certain circumstances and depending on the process, the volume fraction of carbon-monoxide may become greater than 25% whereas the volume fraction of hydrogen may become greater than 10%, reaching 15% of $H_2$ for instance in a blast furnace with natural gas injection. Since CO is highly toxic and since CO and $H_2$ are both highly flammable, releasing blast-furnace off-gas to the atmosphere is hazardous. In fact, off-gas released through a bleeder valve sometimes ignites, e.g. due to incandescent pieces of burden expelled through the bleeder valve, resulting in a meters-long darting flame. In rare cases, explosive clouds have built up above the furnace and led to deflagration explosions. Apart from posing threats relating to uncontrolled combustion and poisoning, off-gas released through bleeder valves obviously causes pollution.

Whereas the bleeder valves are shut at normal operating conditions of the furnace, each time the bleeder valves do open, a considerable amount of hazardous blast furnace off-gas is released to the atmosphere. Moreover, in case of abnormal furnace operation, the bleeder valves may open several times a day. Even in case of a stable process, gas may be released several times a year. Accordingly, there is a need for eliminating or at least reducing the risks caused by blast furnace off-gas emission from bleeder valves.

FIG. 1 shows an arrangement according to Japanese patent application no. 54 107 806, which aims at making blast furnace off-gas discharged from bleeder pipes harmless by burning the off-gas. As seen in FIG. 1, the outlet of several bleeder valves 2 is connected to a common collecting pipe 3 that leads off-gas to a combustion chamber 4. Carbon containing gas is fed by line 5 to the combustion chamber 4 for completely burning the blast furnace off-gas in the chamber 4 before it is released to the atmosphere. This arrangement has a safety installation including fire-extinguishing means for avoiding a backflash of fire from the combustion chamber 4 into the furnace. To this effect, a pressure sensor 7 is provided in the collecting pipe 3. When the sensed pressure in the collecting pipe 3 becomes "negative", a controller 8 shuts off a valve 10 in the carbon gas feed line and opens a valve 11 to inject fire-fighting steam into the collecting pipe 3. When "positive" pressure is sensed, i.e. when off-gas is released through the bleeder valves 2, the steam valve 11 is closed and the carbon gas valve 10 is opened so that combustion of the off-gas in the combustion chamber 4 can be ignited by an ignition device 6 arranged in the combustion chamber 4.

As will be understood, an arrangement according to JP 54 107 806 is rather complex and has considerable installation costs, especially if it is to be adapted to modern high-pressure blast furnace plants. In fact, a collecting pipe designed for collecting bleeder off-gases, as proposed in JP 54 107 806, has to have both a configuration and a support structure that are very robust in order to withstand the considerable forces caused by the bleeder outflow, which may reach supersonic speeds in modern furnaces, the high temperatures and abrasion due to the dust content. It is thus even questionable whether such an arrangement is practically feasible in a modern blast furnace plant.

Another device for burning off-gases in a blast furnace is disclosed in U.S. Pat. No. 3,907,261. Contrary to the aforementioned prior art, this device does not relate to a bleeder valve but to a blow-off discharge valve mounted on the downcomer of a blast furnace. Such valves, often called "shutdown discharge hats", are used only during furnace shutdown to release the comparatively lower quantity of top gas produced during a shutdown. The valve of U.S. Pat. No. 3,907,26 comprises a valve flap that opens inwardly into the valve housing and a tubular member that is axially inserted into the valve housing when the valve flap is opened. The tubular member protects the valve flap and the valve seat from direct exposure to blast furnace gas. The tubular member can be equipped with a flaring device that comprises a tubular extension on the tubular member and a coaxial outer jacket. The extension and jacket define a combustion chamber that is open at its lower end to permit ingress of sufficient air to support combustion. The flaring device further includes an igniter fixed to the outer jacket and extending into the combustion chamber and an injection nozzle coaxially disposed inside the tubular extension for injecting liquid or gaseous fuel. As will be understood, a shutdown discharge hat with a flaring device according to U.S. Pat. No. 3,907,26 is not suitable for use as a bleeder valve for explosion prevention. Among others, its inwardly opening configuration precludes a reliable relief of sudden pressure excesses during furnace operation.

BRIEF SUMMARY

The invention provides a simplified and less cost-intensive arrangement for burning blast furnace off-gas from a bleeder valve and a corresponding bleeder valve.

Accordingly, the present invention proposes an arrangement that comprises a bleeder valve and an apparatus configured for causing combustion of blast furnace off-gas released by the bleeder valve. In typical manner, the bleeder valve includes a fixed hollow valve body and a movable obturator. The valve body defines an inlet and an outlet and provides a valve seat, with which the obturator cooperates for sealing closure of the bleeder valve. The obturator is movable by any appropriate means into an open position for releasing blast furnace off-gas through the outlet. Irrespectively of whether the open position is a controlled position set by means of an actuator or an uncontrolled relief position reached by action of excess pressure, the bleeder valve according to the invention is configured so that the obturator opens outwardly, i.e. so that the furnace pressure exerts a force in opening direction onto the obturator.

According to the present invention, the apparatus for causing combustion includes an ignition device that is arranged either on the valve body or on the moveable obturator. According to an important aspect, the ignition device is arranged so that its spatial ignition range is permanently or temporarily located in a region where blast furnace off-gas released through the outlet mixes with ambient air. Blast-furnace off-gas of typical composition has a sufficiently high calorific value to burn when it is ignited by suitable means in the presence of an appropriate amount of oxygen.

Hence, the off-gas can be ignited downstream and adjacent the outlet by ignition in an appropriately chosen region as set out above. According to a further aspect of the invention, the apparatus is configured so that off-gas is released into ambient air immediately downstream the outlet so that open-air combustion of released off-gas occurs at and above each bleeder valve location. An unconfined and secure space, to which access is typically prohibited during operation, is conventionally available on the bleeder platform and above the blast furnace bleeders arranged thereon.

Accordingly, in contrast to the aforementioned prior art solutions for burning blast furnace off-gas, the present invention has the merit of avoiding costly structural measures for providing a dedicated combustion chamber. Instead, the present invention proposes open-air combustion of the off-gas. As will be understood, the component parts of the bleeder valve are inherently designed to resist the high temperatures of blast furnace off-gas such that besides providing an appropriate ignition device, little if any additional measures are required to flare the off-gas by open-air combustion in an unconfined open space immediately above the bleeder valve.

As will be appreciated, the invention thus provides a cost-effective and yet reliable solution for sufficiently complete and controlled combustion of CO and $H_2$ to eliminate the aforementioned hazards related to emission of these constituents.

The invention also concerns a correspondingly configured bleeder valve.

BRIEF DESCRIPTION OF THE DRAWINGS

Further details and advantages of the present invention will be apparent from the following detailed description of several not limiting embodiments with reference to the attached drawings, wherein.

Throughout FIG. 2 to FIG. 6B, similar or identical elements are identified by identical reference signs.

DETAILED DESCRIPTION

Figure 1:
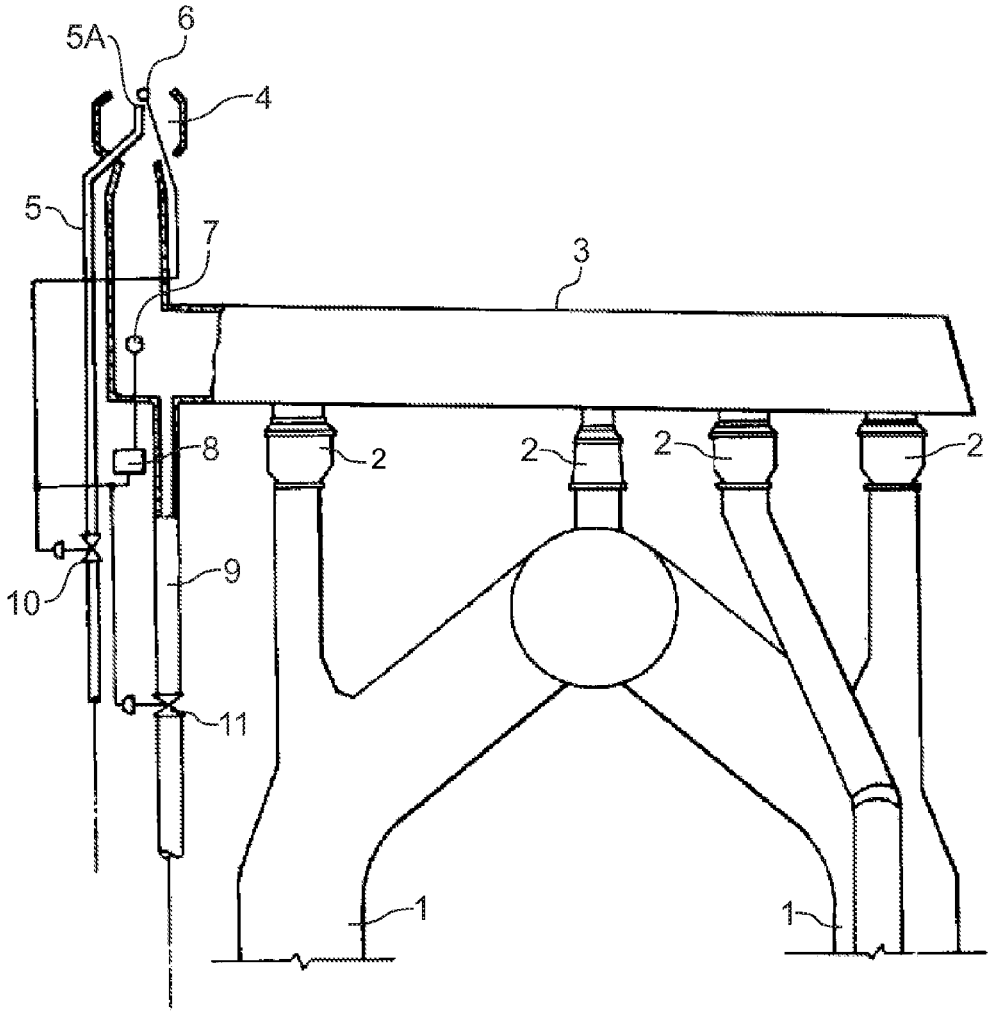
Fig. 1 (PRIOR ART)
FIG. 1 is a partially broken elevation view of a prior art arrangement for burning blast furnace off-gas from a bleeder valve.

FIG. 2 to FIG. 6B show a blast furnace bleeder valve 20 that comprises a hollow valve body 22 and a movable flap-type obturator 24. The valve body 22 defines an outlet 26 and has a valve seat (not shown) that cooperates with the obturator 24 for sealing closure of the bleeder valve 20. In a typical configuration, the valve body 22 has the form of a tubular muff and is provided at its lower end with a mounting flange for fixedly fastening the bleeder valve 20 to an upper end flange of a bleeder pipe (not shown). As will be understood, the bleeder pipe that carries the bleeder valve 20 is typically connected to the upper end region of one or more uptakes, e.g. a pair of joining blast furnace uptakes. Alternatively, it may communicate with a pressure relief duct connected to a blast furnace off-gas scrubber tower. A typical blast furnace plant has several bleeder valves 20 arranged on a bleeder platform above the furnace to which the bleeder pipes lead for discharging the blast furnace off-gas in case of excess pressure.

Figure 2:
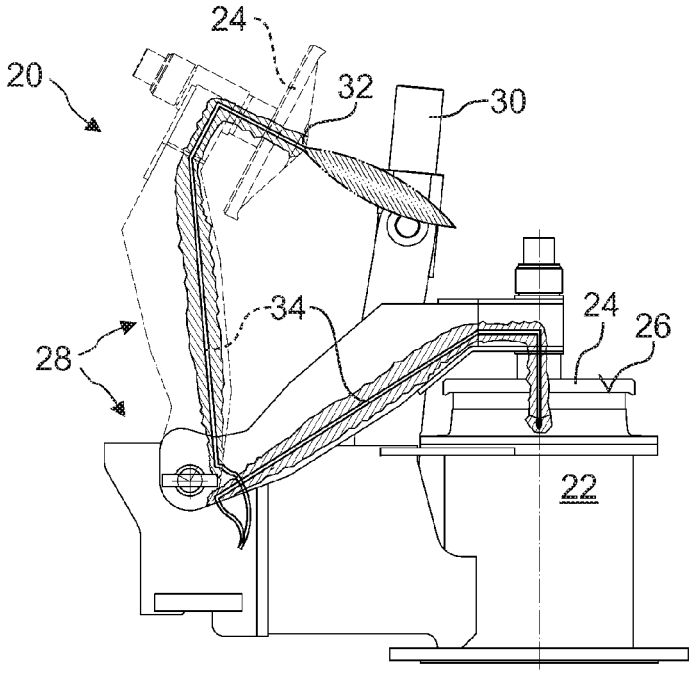
FIG. 2 is a side elevation and partial section illustrating a first arrangement for burning blast furnace off-gas from a bleeder valve according to the invention.
Figure 3:
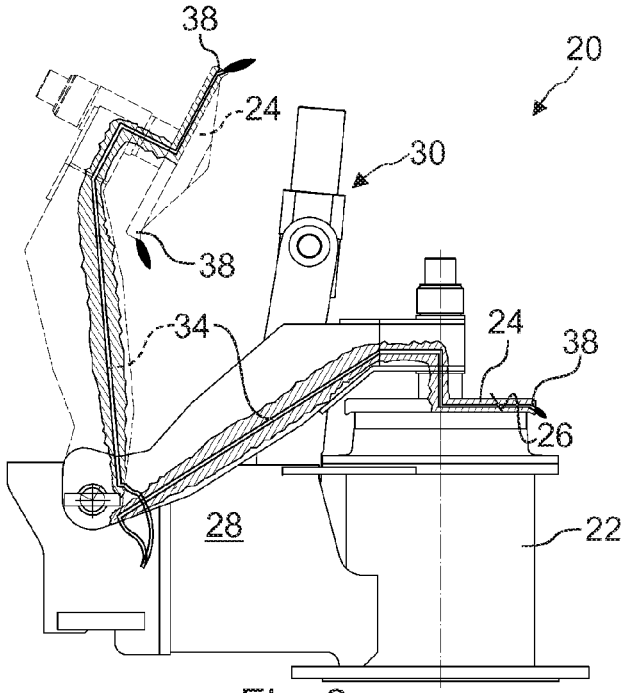
FIG. 3 is a side elevation and partial section illustrating a second arrangement for burning blast furnace off-gas from a bleeder valve according to the invention.
Figure 4A:
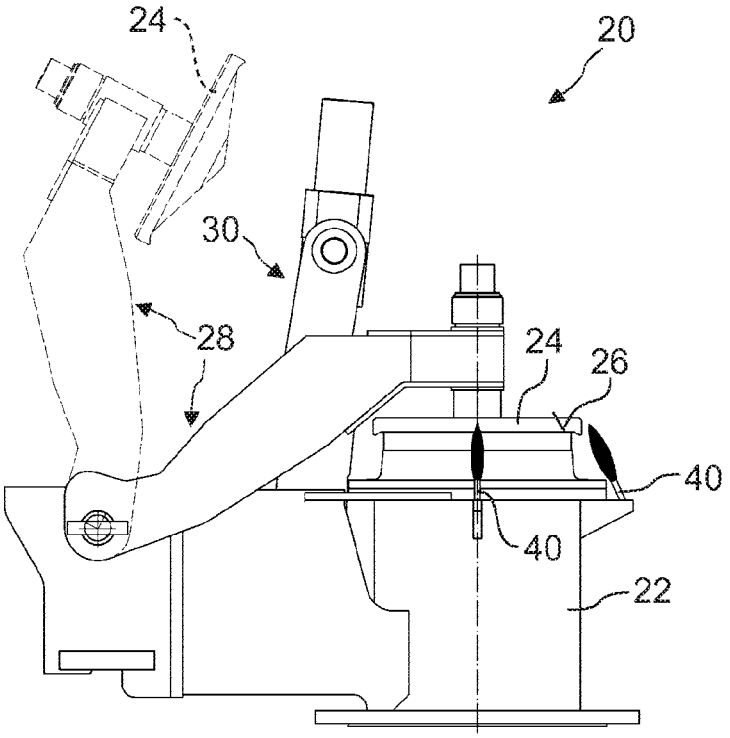
FIG. 4A and FIG. 4B are a side elevation and plan view illustrating a third arrangement for burning blast furnace off-gas from a bleeder valve according to the invention.
Figure 5A:
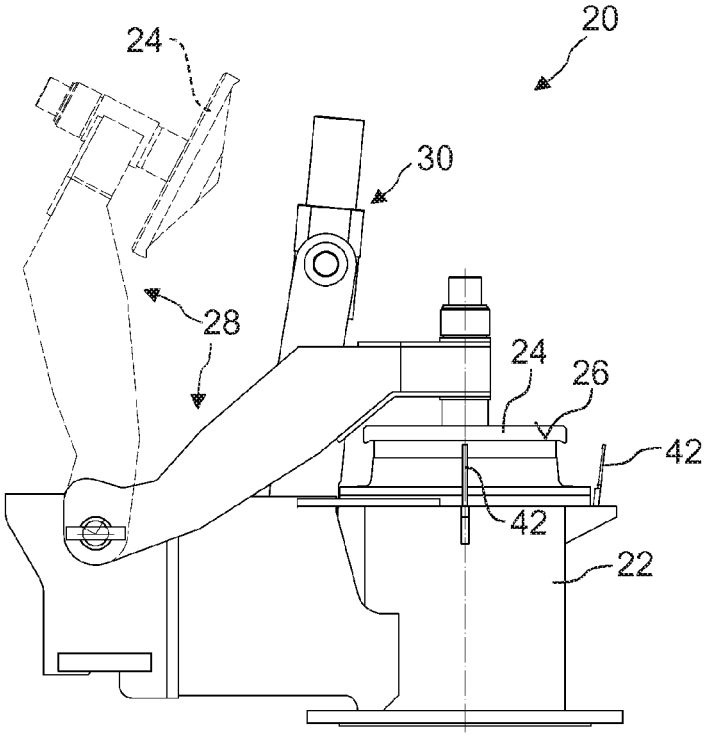
FIG. 5A and FIG. 5B are a side elevation and plan view illustrating a fourth arrangement for burning blast furnace off-gas from a bleeder valve according to the invention.
Figure 6A:
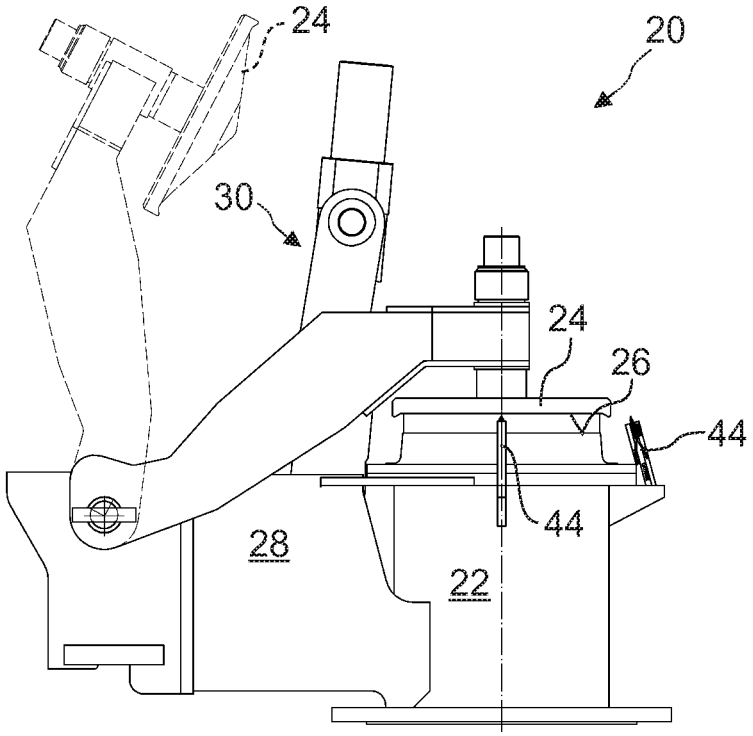
FIG. 6A and FIG. 6B are a side elevation and plan view illustrating a fifth arrangement for burning blast furnace off-gas from a bleeder valve according to the invention.

In known manner as disclosed in WO 2007/090747, the obturator 24 is connected to an actuating mechanism 28 provided with a hydraulic actuator for moving the obturator from a closed position on the valve seat into a controlled first open position distant from the valve seat, illustrated by broken lines in FIGS. 2-3 and in FIGS. 4A, 5A & 6A. When the actuating mechanism 28 is operated, e.g. in case of long-term procedures such as blow-in or blow-out, blast furnace off-gas is released in controlled manner through the outlet 26. Furthermore, the bleeder valve 20 comprises a safety contrivance 30 with biasing disk-springs urging the obturator 24 against the valve seat in the closed position. The safety contrivance 30 allows emergency opening of the obturator 24 into a second emergency open position when pressure inside the bleeder pipe, i.e. inside the hollow valve body 22 exceeds an admissible value set by adjusting the biasing force exerted by the safety contrivance 30. Emergency opening normally occurs in case of fast and high pressure peaks, with the obturator 24 being translated into its second open position several tens of millimeters above the outlet 26, due to pressure exerting a force exceeding the biasing force of the safety contrivance 30. As seen in FIGS. 2-3, in order to ensure its emergency opening function, the bleeder valve 20 is configured so that the obturator 24 opens outwardly, i.e. so that furnace pressure exerts an opening force onto the obturator 24 pushing it away from its valve seat. Further details of the actuating mechanism 28 are found in WO 2007/090747, the disclosure of which is incorporated by reference herein. As will be understood however, the obturator 24 may be connected to any other suitable type of actuating mechanism permitting controlled relief and/or emergency relief of excess pressure.

According to the invention, the bleeder valve 20 of FIG. 2 to FIG. 6B forms part of an arrangement for burning blast furnace off-gas discharged by the bleeder valve 20.

In the embodiment of FIG. 2, the bleeder valve 20 comprises an ignition device with an ignition flame nozzle 32 that is sunk-in i.e. embedded concentrically into the obturator 24. The ignition flame nozzle 32 is configured to provide an ignition flame projecting from the centre of the obturator 24 towards the axis of the valve body 22. The ignition flame nozzle 32 is connected to a gas feed conduit 34, which feeds a mix of carbon rich gas, e.g. natural gas, basic-oxygen-furnace gas or coke-oven gas, and high-pressure air or oxygen from a remote source to the nozzle 32. As will be appreciated, the spatial ignition range of the ignition flame nozzle 32 passes a through a region where blast furnace off-gas mixes with ambient air to form an ignitable mix, when the obturator 24 is moved from the closed position into to the first controlled open position (see broken lines). In addition, or alternatively, the ignition flame nozzle 32 is configured to create an ignition flame sufficiently long to reach into the cylindrical envelope of the main flow path of off-gas above the outlet 26 when the obturator is in the first open position, accordingly passing through a region where blast furnace off-gas released through the outlet mixes with ambient air after the obturator has reached the first open position, i.e. the controlled open position. Accordingly, the ignition flame nozzle 32 provides a flame initiating open-air combustion of blast furnace off-gas released into ambient air by the bleeder valve 20. In other words, the blast furnace off-gas is burned in an unconfined space instead of being burned in a dedicated combustion chamber. As further seen in FIG. 2, the gas feed conduit 34 is arranged to pass inside the supporting arm of the mechanism 28 and inside the obturator 24 to be protected from the effects of such combustion.

FIG. 3 illustrates a second arrangement according to the invention, in which several ignition flame nozzles 38 are sunk-in at regular intervals in radial and downwardly slanting direction in the periphery of the obturator 24. The ignition flame nozzles 38 are configured to create ignition flames that are directed radially away from and slanting downwards in the closing direction of the obturator 24. As in FIG. 2, the gas feed conduit 34 for the nozzles 38 is also arranged to pass inside the supporting arm of the mechanism 28 and inside the obturator 24. As opposed to the embodiment of FIG. 2 however, the arrangement of FIG. 3 enables combustions of the off-gas in case of emergency opening of the bleeder valve 20, i.e. when the obturator 24 is located in the uncontrolled emergency position at a small distance above the outlet 26. In fact, when the obturator 24 is in this second open position in the embodiment of FIG. 3, the ignition range of the ignition flame nozzles 38 is located downstream the outlet 26 in a region where released blast furnace off-gas mixes with ambient air. As will be understood however, a bleeder valve 20 according to the invention may be provided with a combination of ignition flame nozzles 38 according to FIG. 3 and an ignition flame nozzle 32, 38 according to FIG. 2 or FIG. 3 to allow ignition in both the controlled and the uncontrolled open positions of the obturator 24. It remains to be noted that the ignition device in the embodiments of FIG. 2-3 further comprises a suitable component for igniting the ignition flame of each ignition flame nozzle 32, 32, 38, which is preferably also sunk-in into the obturator 24. Preferably, such component is a very-fast-acting electric igniter, e.g. of the spark plug type.

Figure 4B:
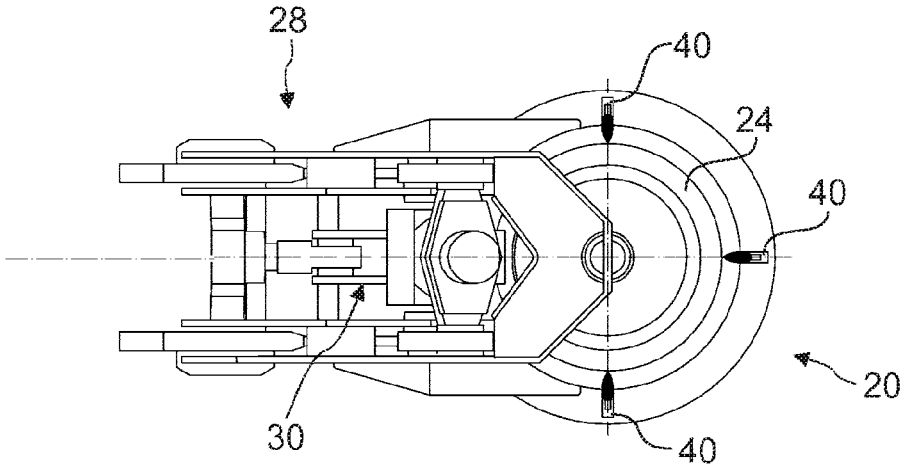

FIG. 4A and FIG. 4B show a third arrangement, in which the ignition device includes several ignition flame lances 40 that are mounted by means of mounting ribs laterally on the periphery of the valve body 22. The ignition flame lances 40 are mounted at regular intervals and with their upper end located below the outlet 26. As in the previous embodiments, each ignition flame lance 40 is connected to a suitable combustion gas feed line (not shown) and provided with an associated, preferably fast-acting, ignition component for igniting the ignition flame on demand. As seen in FIG. 4A, the ignition flame lances 40 are configured to provide ignition flames that are directed towards the outflow of off-gas, i.e. upwards in the outflow direction and radially inwards toward the central axis of the valve body 22, and so as to reach into or through the region of turbulence where released blast furnace off-gas mixes with ambient air. In order to be protected from the impact forces of released off-gas, the ignition flame lances 40 are arranged in "wind-shadow" of released off-gas, i.e. so as to be sheltered from off-gas outflow released into ambient air when the obturator 24 is in either the first or the second open position.

Figure 5B:
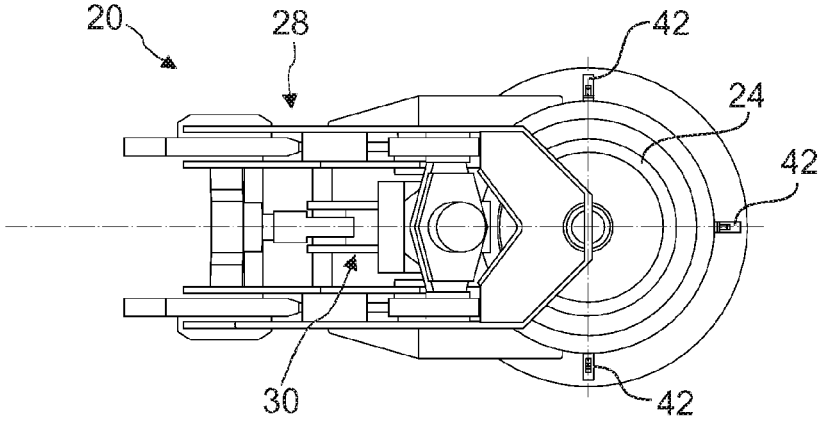

FIG. 5A and FIG. 5B show a fourth arrangement, which differs from the preceding embodiment mainly in that the ignition device includes, instead of ignition flame lances, several electric spark igniters 42, e.g. high-voltage coil igniters, that are mounted on the periphery of the valve body 22. Each electric spark igniter 42 is configured to direct its ignition spark towards the off-gas outflow and so that its ignition spark is located within the ignitable zone where off-gas mixes with ambient air. As will be appreciated, the ignition device of FIG. 5A and FIG. 5B does not require any additional gas feed lines for causing combustion of blast furnace off-gas.

Figure 6B:
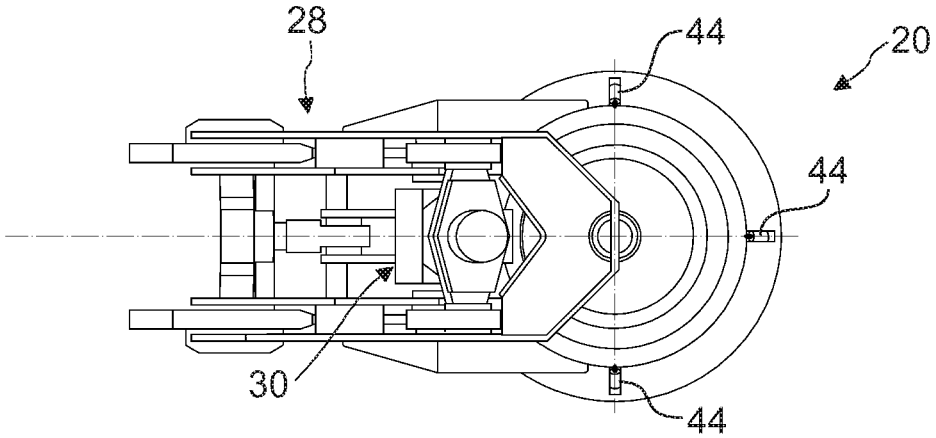

FIG. 6A and FIG. 6B show a fifth embodiment, which differs from the preceding arrangement of FIGS. 5A-B mainly in that the ignition device includes, instead of electric spark igniters, several plasma torches 44 connected to appropriate supply lines and positioned below the outlet 26 as set out above. Accordingly, the plasma torches 44 are also arranged in the "wind-shadow" and to create a plasma jet that is directed towards the off-gas outflow and to penetrate the turbulence region where off-gas mixes with ambient air.

A suitable location for arranging the ignition flame lances 40, the spark igniters 42 or the plasma torches 44 according to FIGS. 4A-B, FIGS. 5A-B or FIGS. 6A-B respectively so as to be sheltered from off-gas outflow depends on the actual valve configuration and can be readily determined by the skilled person. As will be understood, a region sheltered from the off-gas ("wind-shadow"), while not meaning absolute calm, is to mean a region of lower flow velocities that are sufficiently low to safely avoid damage to the protruding components of the respective ignition device. To this effect, computer-assisted computational fluid dynamics may be used to determine the off-gas velocity fields for controlled and/or emergency opening and to select regions in which impact impulse and abrasion are sufficiently low.

Although not illustrated in the drawings, it will be appreciated that the ignition device preferably comprises a controller connected to one or more sensors for detecting motion of the obturator 24. Depending on the embodiment, the controller is configured to activate either the ignition components associated to the ignition flame nozzles 32, 32, 38 or to the ignition flame lances 40 or to activate the spark igniters 42 or the plasma torches 44 in case obturator motion 24 is detected. When using a mechanism 28 according to WO 2007/090747, the latter is preferably equipped with two sensors for detecting motion into the first and second open positions respectively. To this effect, the mechanism 28 can be equipped with a first encoder arranged to sense pivoting of the supporting arm on which the obturator 24 is mounted and a second encoder arranged to measure displacement against the biasing spring inside the safety contrivance 30. When providing on-demand activation of the ignition device, rapidly ignitable components, e.g. spark igniters, are preferably used to minimize release of unburned gas. Alternatively, or in addition, an ignition device of the pilot flame type, i.e. a device that provides a permanent source of ignition may be used.

Each of the above embodiments, irrespective of whether the ignition device is arranged on the valve body 20 or the moveable obturator 24, is configured so that, when the obturator 24 is in its first and/or second open position, the ignition range is located, at least temporarily, downstream the outlet in a region of turbulence, where blast furnace off-gas released through the outlet mixes with ambient air to form an ignitable mix. Such region can also readily be determined by the skilled person, e.g. on the basis of computer-assisted computational fluid dynamics aiming at determining ignitable zones near the bleeder valve.

As will be appreciated and as opposed to the prior art arrangement illustrated in FIG. 1, the arrangements of FIGS. 2-6 are configured for causing open-air combustion of blast furnace off-gas released into ambient air immediately above the bleeder valve 20, i.e. in a free and unconfined space as typically available above the bleeder platform. In other words, with an arrangement according to the invention, there is no need for, among others, the cost-intensive collecting duct and additional combustion chamber used in the prior art solution of FIG. 1. Furthermore, arrangements of FIGS. 2-6 are configured to cause combustion at each bleeder valve 20 separately so that failure of a single ignition device does not lead to uncontrolled hazardous emission from all bleeder valves. As will be understood, while providing the ignition devices on the bleeder valve body 22 or on the obturator 24 provides a compact bleeder valve unit, they may also be installed adjacent either of the latter provided the ignition range meets the aforementioned region of off-gas and oxygen mixture.

Finally, it remains to be noted, that a bleeder valve provided with a combination of ignition devices according to any of the arrangements of FIGS. 2-6 is also within the scope of the present invention. A particularly preferred embodiment comprises electric spark igniters according to FIGS. 5A-B for ensuring ignition in the emergency open position of the obturator 24 and a flame nozzle or flame lances according to either FIG. 2 or FIGS. 4A-B for ensuring ignition in the controlled open position of the obturator 24.

The invention claimed is:

1. An arrangement for burning blast furnace off-gas from a bleeder valve, said arrangement comprising:

a bleeder valve having a fixed hollow valve body defining an outlet and having a valve seat; and an outwardly movable obturator that cooperates with said valve seat for closing said bleeder valve and that is movable outwardly into an open position for releasing blast furnace off-gas through said outlet;

an apparatus configured for causing combustion of blast furnace off-gas released by said bleeder valve;

an ignition device that is arranged on said valve body or said outwardly moveable obturator, wherein said valve body is located downstream said outlet; and with its ignition range located downstream said outlet in a region where blast furnace off-gas released through said outlet mixes with ambient air when said obturator is in an open position;

wherein said apparatus is configured for causing open-air combustion of blast furnace off-gas released into ambient air by said bleeder valve.

2. The arrangement according to claim 1, wherein said ignition device is mounted on said valve body or on said moveable obturator so as to be sunk-in in said valve body or in said moveable obturator; or so as to be sheltered from an outflow of off-gas released into ambient air when said obturator is in an open position.

3. The arrangement according to claim 1, wherein said ignition device comprises a controller connected to at least one sensor arranged to detect motion of said obturator and configured to activate said ignition device when said obturator moves into an open position.

4. The arrangement according to claim 1, wherein said ignition device comprises at least one ignition flame nozzle that is mounted on said moveable obturator so as to direct an ignition flame towards an outflow of off-gas released into ambient air when said obturator is in an open position.

5. The arrangement according to claim 4, wherein said at least one ignition flame nozzle is sunk-in in said moveable obturator.

6. The arrangement according to claim 1, wherein said ignition device comprises at least one ignition flame lance that is mounted on a periphery of said valve body so as to direct an ignition flame towards an outflow of off-gas released into ambient air when said obturator is in an open position.

7. The arrangement according to claim 6, wherein said ignition flame lance is mounted so as to be sheltered from an outflow of off-gas released into ambient air when said obturator is in an open position.

8. The arrangement according to claim 1, wherein said ignition device comprises several electric spark igniters that are mounted on the periphery of said valve body so as to direct an ignition spark towards an outflow of off-gas released into ambient air when said obturator is in an open position.

9. The arrangement according to claim 8, wherein said electric spark igniters are mounted so as to be sheltered from an outflow of off-gas released into ambient air when said obturator is in an open position.

10. The arrangement according to claim 1, wherein said ignition device comprises several plasma torches that are mounted on a periphery of said valve body so as to direct a plasma jet towards an outflow of off-gas released into ambient air when said obturator is in an open position.

11. The arrangement according to claim 10, wherein said plasma torches are mounted so as to be sheltered from an outflow of off-gas released into ambient air when said obturator is in an open position.

12. The arrangement according to claim 1, wherein said bleeder valve further comprises an actuating mechanism connected to said obturator for moving said obturator between a closed position on said valve seat and a first open position distant from said valve seat;

a safety contrivance having biasing means for urging said obturator against said valve seat in said closed position and allowing emergency opening of said obturator into a second open position when pressure inside said hollow valve body exceeds an admissible value;

wherein said ignition device is arranged with an ignition range located downstream said outlet in a region where blast furnace off-gas released through said outlet mixes with ambient air when said obturator is in either said first open position or in said second open position.

13. The arrangement according to claim 12, wherein said ignition device comprises:

at least one ignition flame nozzle that is mounted on said moveable obturator or at least one ignition flame lance that is mounted on the periphery of said valve body, so as to direct an ignition flame into a region where blast furnace off-gas released through said outlet mixes with ambient air when said obturator is in said first open position; and several electric spark igniters that are mounted on the periphery of said valve body so as to direct an ignition spark into a region where blast furnace off-gas released through said outlet mixes with ambient air when said obturator is in said second open position.

14. The arrangement according to claim 1, wherein said bleeder valve is mounted on top of a bleeder pipe that is connected through one or more uptake ducts to a top cone of a blast furnace.

15. The arrangement according to claim 1, wherein said bleeder valve is mounted on top of a bleeder pipe that is connected through a pressure relief duct to a scrubber tower of a blast furnace off-gas cleaning installation.

16. Blast furnace plant comprising at least two arrangements according to claim 14.

17. A bleeder valve for releasing blast furnace off-gas in a blast furnace plant, said bleeder valve comprising a fixed hollow valve body defining an outlet and having a valve seat;

an outwardly movable obturator that cooperates with said valve seat for closing said bleeder valve and that is movable outwardly into an open position for releasing blast furnace off-gas through said outlet;

an ignition device that is arranged on said valve body or on said outwardly moveable obturator, wherein said valve body is located downstream said outlet; and with its ignition range located downstream said outlet in a region where blast furnace off-gas released through said outlet mixes with ambient air when said obturator is in an open position;

wherein said bleeder valve is configured for causing open-air combustion of blast furnace off-gas released into ambient air by said bleeder valve; and an actuating mechanism connected to said obturator for moving said obturator between a closed position on said valve seat and a first open position distant from said valve seat.

18. The bleeder valve according to claim 17, wherein said bleeder valve further comprises:

a safety contrivance having biasing means for urging said obturator against said valve seat in said closed position and allowing emergency opening of said obturator into a second open position when pressure inside said hollow valve body exceeds an admissible value;

wherein said ignition device is arranged with an ignition range located downstream said outlet in a region where blast furnace off-gas released through said outlet mixes with ambient air when said obturator is in either said first open position or in said second open position.

19. Blast furnace plant comprising one arrangement according to claim 15.

* * * * *